US007448399B2

(12) United States Patent
Song et al.

(10) Patent No.: US 7,448,399 B2
(45) Date of Patent: Nov. 11, 2008

(54) UMBRELLA

(76) Inventors: Nam Soo Song, Dean Funes 911, Rosario (2000), Santa Fe (AR); Tae Keun Song, Dean Funes 911, Rosario (2000), Santa Fe (AR)

( * ) Notice: Subject to any disclaimer, the term of this patent is extended or adjusted under 35 U.S.C. 154(b) by 0 days.

(21) Appl. No.: 11/717,763

(22) Filed: Mar. 14, 2007

(65) Prior Publication Data

US 2007/0227569 A1 Oct. 4, 2007

(30) Foreign Application Priority Data

Mar. 31, 2006 (KR) ..... 10-2006-0029461

(51) Int. Cl.
*A45B 25/20* (2006.01)
*A45B 25/18* (2006.01)

(52) U.S. Cl. ..... 135/33.7; 135/33.41

(58) Field of Classification Search ..... 135/33.4–33.5, 135/33.7, 31–32, 33.2, 33.41
See application file for complete search history.

(56) References Cited

U.S. PATENT DOCUMENTS 5,078,166 A * 1/1992 Lee ..... 135/33.7
6,006,769 A * 12/1999 Lin ..... 135/33.7
6,024,109 A * 2/2000 Lin et al. ..... 135/33.7
6,089,244 A * 7/2000 Ko ..... 135/33.7
6,155,278 A * 12/2000 Lin ..... 135/33.7
6,237,616 B1 * 5/2001 You ..... 135/33.7
6,520,193 B2 * 2/2003 You ..... 135/33.7
6,681,784 B2 * 1/2004 Chou et al. ..... 135/33.7
2004/0211452 A1 * 10/2004 Wu ..... 135/33.7

FOREIGN PATENT DOCUMENTS

JP 11056433 A * 3/1999

* cited by examiner

*Primary Examiner*—Winnie Yip
(74) *Attorney, Agent, or Firm*—Harrity & Harrity, LLP

(57) ABSTRACT

An umbrella includes an umbrella support, a plurality of umbrella ribs that are installed on an upper portion of the umbrella support and that are capable of being folded, a plurality of support ribs respectively supporting the umbrella ribs, a slider to which an end of each of the support ribs is hingedly coupled and which slides along the umbrella support to fold or unfold the umbrella ribs and the support ribs, and a canopy giving a user shelter from rays of the sun, rain, or snow. The canopy is divided into an upper canopy installed on upper portions of the umbrella ribs and a lower canopy installed on lower portions of the umbrella ribs. A space is formed between the upper and low canopies when the umbrella is unfolded.

5 Claims, 6 Drawing Sheets

UMBRELLA

CROSS REFERENCE TO RELATED APPLICATION

This application claims priority to and the benefit of Korean Application No. 10-2006-0029461 filed in the Korean Patent Office on Mar. 31, 2006, the entire content of which is incorporated hereinto by reference.

FIELD OF THE INVENTION

The present invention relates to an umbrella and, more particularly, to an umbrella that can allow a user to secure a clear front view while minimizing deformation caused by wind resistance.

BACKGROUND OF THE INVENTION

Generally, an umbrella is a device carried to give shelter from rain, rays of the sun, snow, etc.

A typical umbrella includes an umbrella support, a plurality of umbrella ribs that are installed on an upper portion of the umbrella support and that are capable of being folded, support ribs respectively supporting the umbrella ribs, and a canopy that is fixed on the umbrella ribs to give a user shelter from rays of the sun, rain, or snow.

The umbrella ribs are hingedly fixed on an upper fixing portion of the umbrella support by hinge pins. Each of the support ribs has a first end that is hingedly connected to the corresponding umbrella rib and a second end that is hingedly coupled to a slider that is capable of vertically sliding along the umbrella support.

When the slider moves to an upper portion of the umbrella support, the support ribs and the umbrella ribs are unfolded outward and thus the canopy is unfolded. When the slider moves to a lower portion of the umbrella support, the support ribs and the umbrella ribs are folded and thus the canopy is folded.

In the conventional umbrella, the canopy is formed of a single member. Therefore, in strong winds, the resistance against the wind increases and thus the umbrella ribs and the canopy may be turned inside out.

Furthermore, when the user is heading in a direction into the wind, he or she has to advance in a state where the umbrella is inclined toward the wind. With the umbrella positioned in this manner, since the user cannot secure a clean front view, the user may encounter unpleasant or even dangerous situations such as walking into puddles or into fixed structures.

SUMMARY OF THE INVENTION

Exemplary embodiments of the present invention provide an umbrella that has a canopy that is divided into an upper canopy and a lower canopy to provide a space between the upper and lower canopy, thereby allowing a user to secure a clear front view through the space while minimizing umbrella deformation caused by wind resistance.

In an exemplary embodiment, an umbrella includes an umbrella support, a plurality of umbrella ribs that are installed on an upper portion of the umbrella support and that are capable of being folded, a plurality of support ribs respectively supporting the umbrella ribs, a slider to which an end of each of the support ribs is hingedly coupled and which slides along the umbrella support to fold or unfold the umbrella ribs and the support ribs, and a canopy giving a user shelter from rays of the sun, rain, or snow, wherein the canopy is divided into an upper canopy installed on upper portions of the umbrella ribs and a lower canopy installed on lower portions of the umbrella ribs, and a space is formed between the upper and low canopies when the umbrella is unfolded.

The lower canopy may be fixed on bottom portions of space maintaining portions fixedly inserted around the respective umbrella ribs, and the upper canopy may be located on top surfaces of the umbrella ribs so that an upper portion of the lower canopy is spaced apart from a lower portion of the upper canopy in a vertical direction, thereby defining the space.

A lower portion of the upper canopy may overlap partly with an upper portion of the lower canopy in a circumferential direction.

The lower canopy may be provided with a blocking step for preventing rainwater from entering into the umbrella.

Each of the space maintaining portions may be gradually widened as it goes from a lower portion of the corresponding umbrella rib toward an upper portion of the corresponding umbrella rib.

An upper portion of the lower canopy may be connected to the corresponding umbrella rib by a loop.

The space may be formed along an entire circumference of the canopy or along a portion of the circumference of the canopy.

BRIEF DESCRIPTION OF THE DRAWINGS

These and/or other aspects and advantages of the invention will become apparent and more readily appreciated from the following description of embodiments of the invention, taken in conjunction with the accompanying drawings of which.

DETAILED DESCRIPTION OF THE INVENTION

Figure 1:
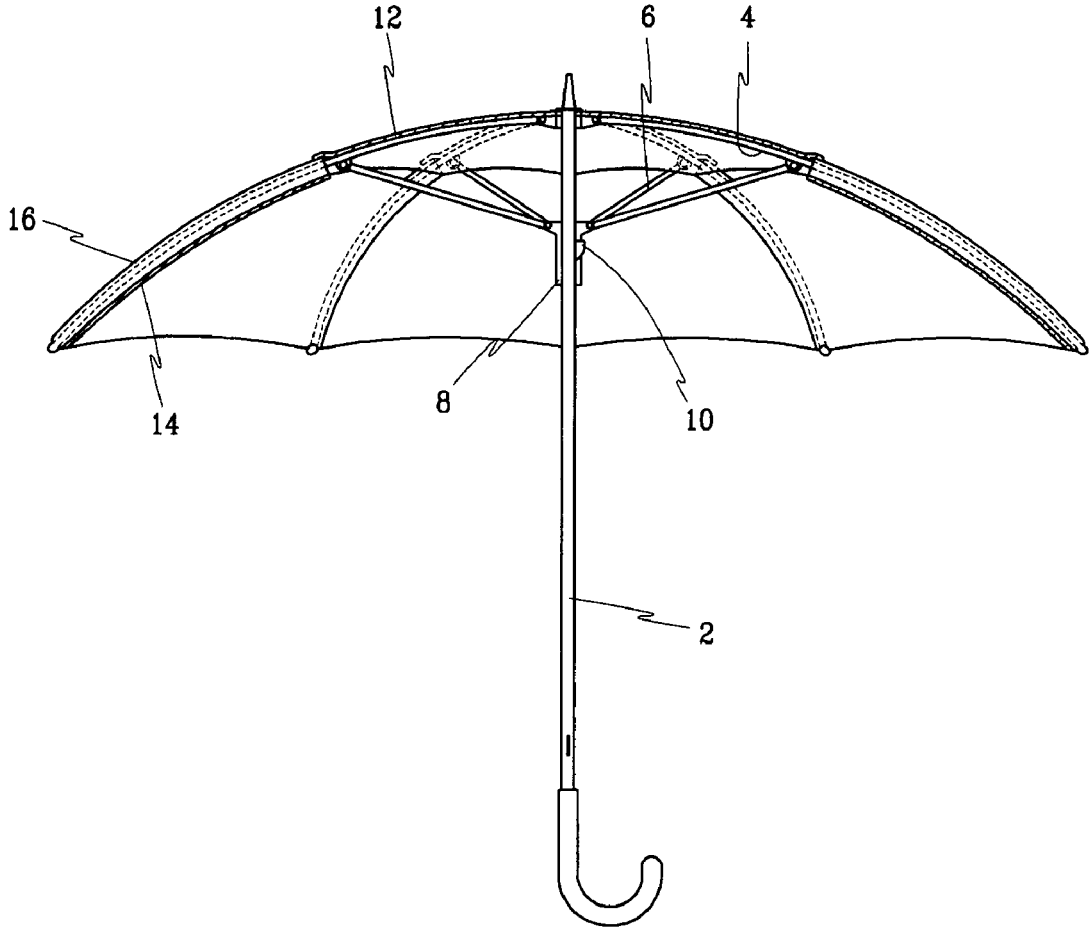
FIG. 1 is a side sectional view of an umbrella according to an exemplary embodiment of the present invention.

With reference to the accompanying drawings, embodiments of the present invention will be described in order for those skilled in the art to be able to implement it. As those skilled in the art would realize, the described embodiments may be modified in various different ways, all without departing from the spirit or scope of the present invention. Wherever possible, the same reference numbers will be used throughout the drawings to refer to the same or like parts.

The basic inventive concept of the present invention can be identically applied to all types of umbrellas such as umbrellas for rain or snow, parasols for protection against rays of the sun, etc. In an exemplary embodiment, the inventive concept is applied to an umbrella by way of example.

An umbrella of the present exemplary embodiment includes an umbrella support 2, a plurality of umbrella ribs 4 that are installed on an upper portion of the umbrella support 2 and that are capable of being folded, support ribs 6 respectively supporting the umbrella ribs 4, a slider 8 to which an end of each of the support ribs 6 is hingedly coupled and which slides along the umbrella support 2 to fold or unfold the umbrella ribs 4 and the support ribs 6, and a canopy giving a user shelter from rays of the sun, rain, or snow.

Each of the rain ribs 4 has a first end that is hingedly coupled to a fixing portion of the umbrella support 2. Each of the support ribs 6 has first and second ends that are respectively and hingedly coupled to the corresponding umbrella rib 4 and the slider 8.

The umbrella support 2 is provided with a fixing portion 10 for releasably fixing a position of the slider 8 to maintain an unfolded state of the umbrella.

The canopy of this exemplary embodiment includes an upper canopy 12 installed above the umbrella ribs 4 and a lower canopy 14 installed under the umbrella ribs 4.

Figure 2:
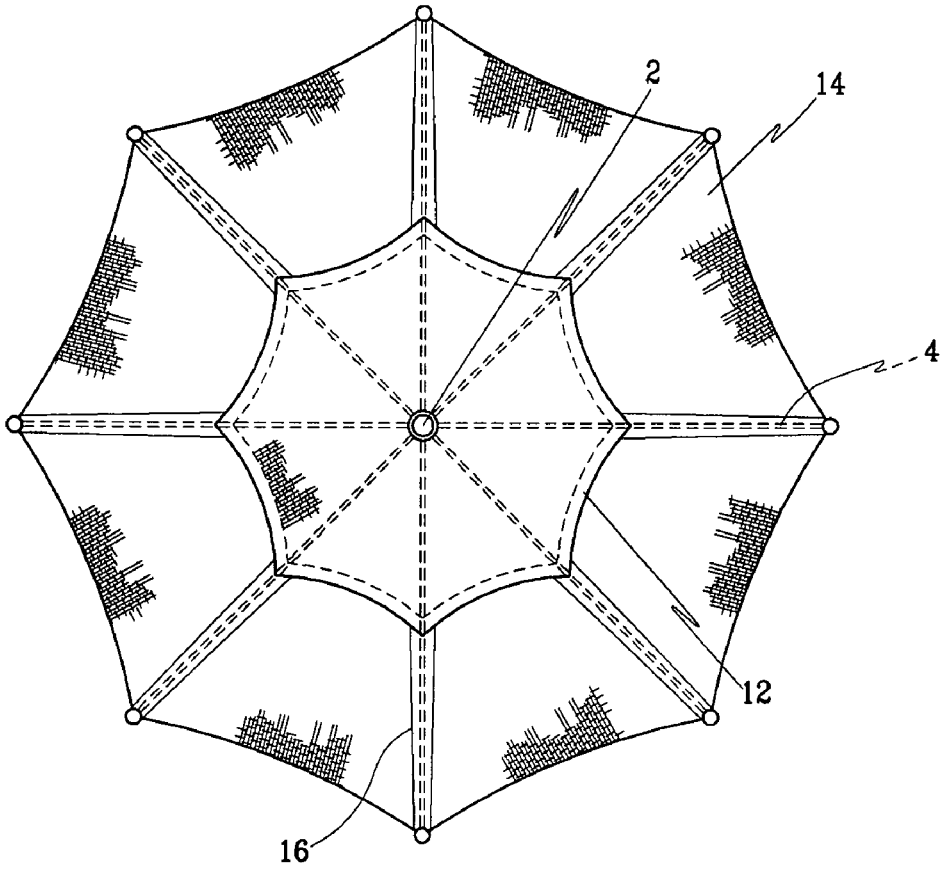
FIG. 2 is a top plane view of the umbrella of FIG. 1.

When the umbrella is unfolded, a bottom surface of the upper canopy 12 is spaced apart from a top surface of the lower canopy 14 to define a space between the upper and lower canopies 12 and 14. As shown in FIG. 2, the upper canopy 12 is located and sized to cover about ½ of a length of each of the umbrella ribs 4. A lower end of the upper canopy 12 is attached on the umbrella ribs 4 using conventional coupling techniques.

Figure 3:
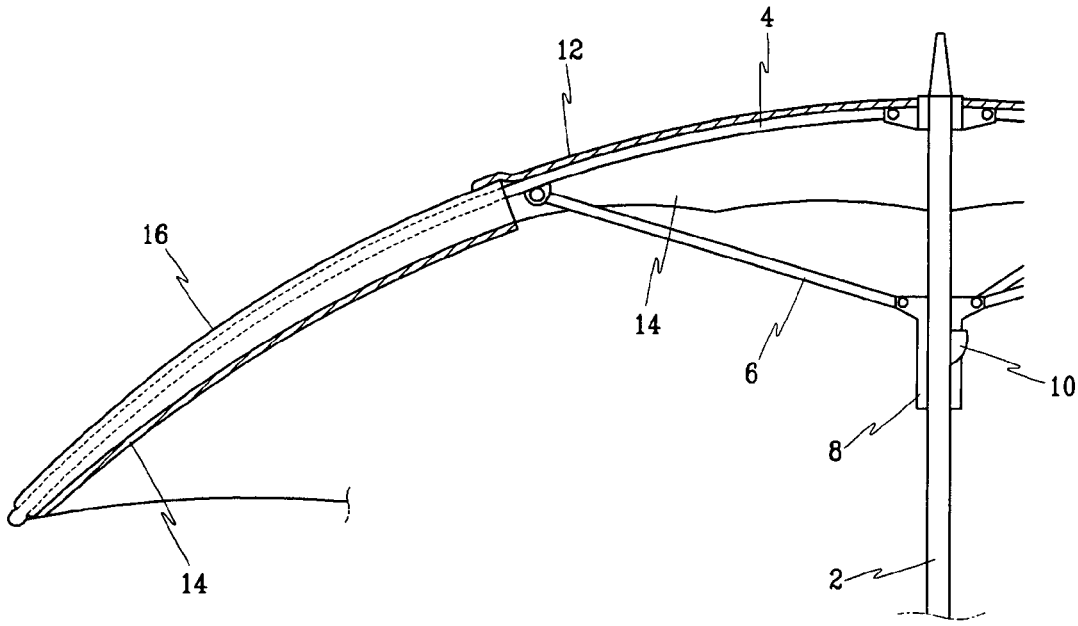
FIG. 3 is an enlarged view of a major portion of the umbrella of FIG. 1.
Figure 4A:
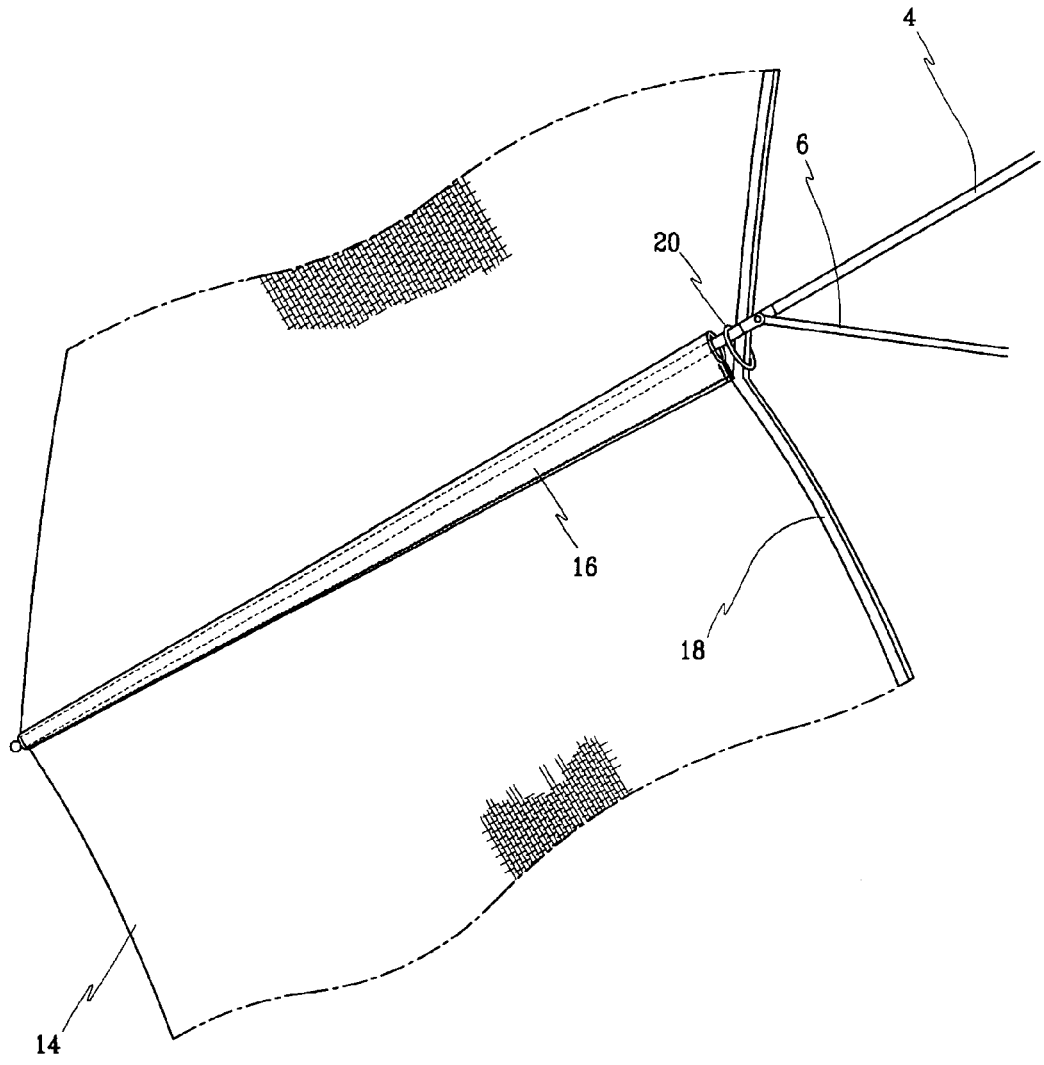
FIG. 4A is a partly enlarged perspective view illustrating an installation state of a lower canopy of the umbrella of FIG. 1.
Figure 4B:
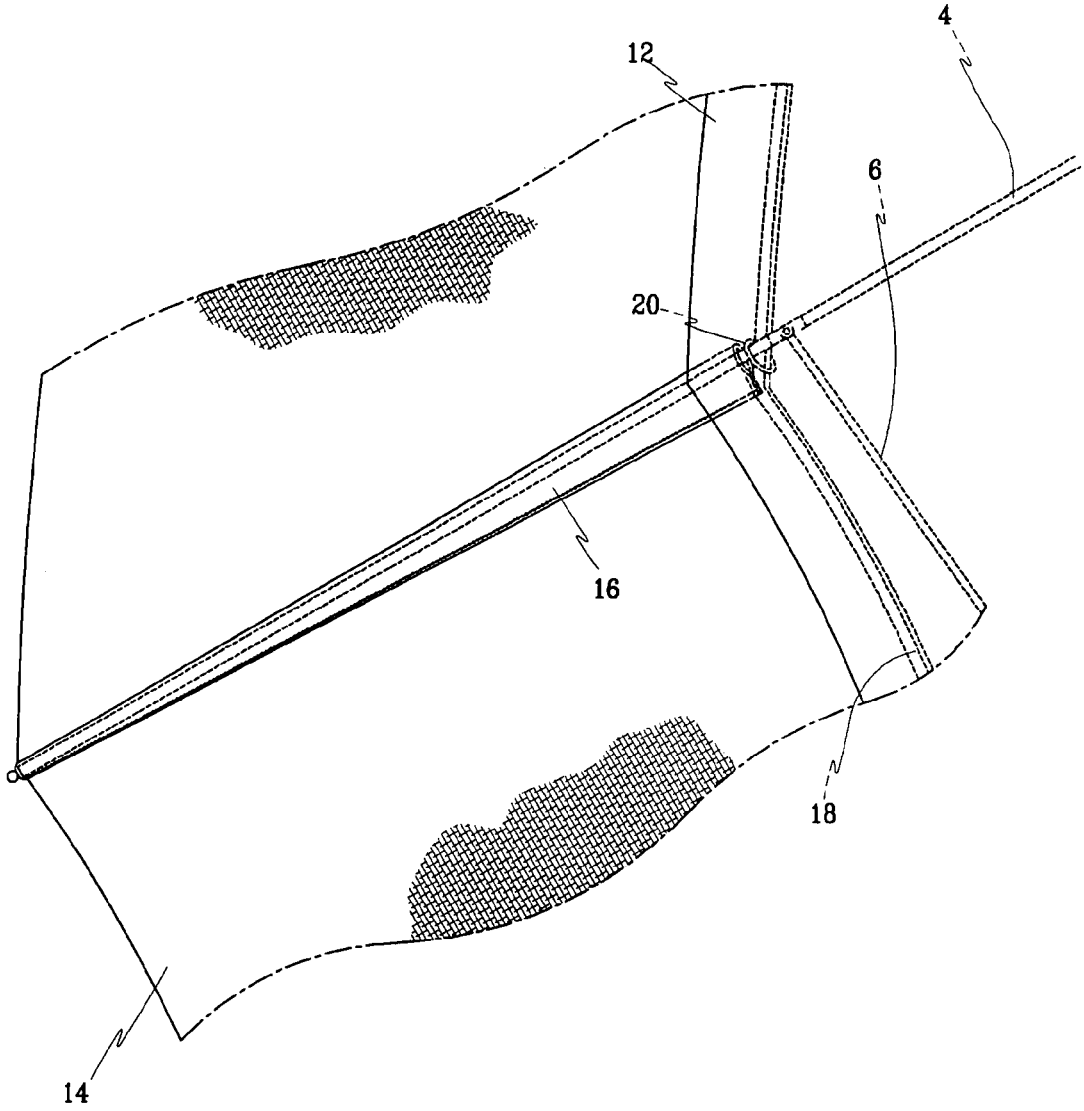
FIG. 4B is a partly enlarged perspective view illustrating an installation state of an upper canopy of the umbrella of FIG. 1.
Figure 5:
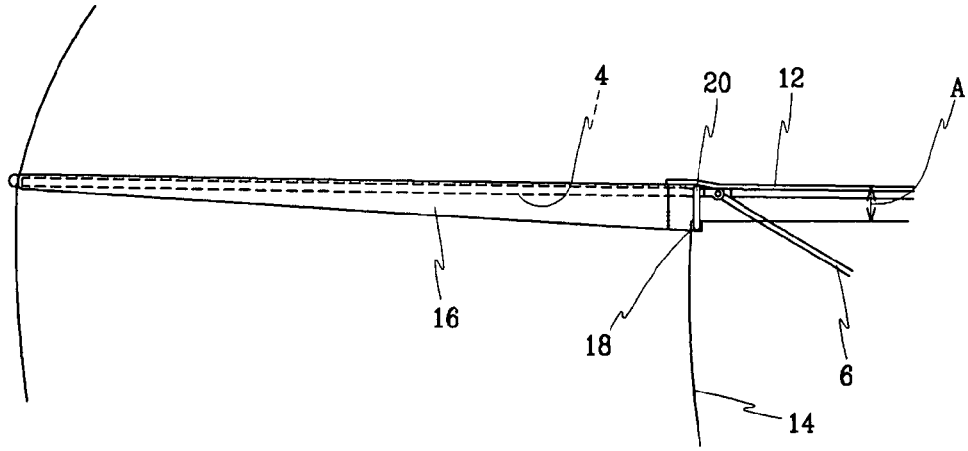
FIG. 5 is a side view of FIG. 4B.

In order to form the space between the upper and lower canopies 12 and 14, as shown in FIGS. 1, 2, and 3, the upper canopy 12 has a predetermined radius with reference to the umbrella support 2 and is attached to top portions of the umbrella ribs 4, and the lower canopy 14 is overlapped by a predetermined width by the upper canopy 12 and is attached on a bottom portion of the umbrella ribs 4.

According to this exemplary embodiment, each of the umbrella ribs 4 is provided with a space maintaining portion 16 so that an upper circumference of the lower canopy 14 can be located at a lower horizontal plane than a lower circumference of the upper canopy 12.

Each of the space maintaining portions 16 is formed of a similar or identical material to the upper and lower canopies 12 and 14. Each of the space maintaining portions 16 has first and second ends. A width of the first end of each of the space maintaining portions 16 is less than that of the second end of the space maintaining portion 16. Each of the space maintaining portions 16 is inserted and attached around a lower portion of the corresponding umbrella rib 4 through needlework or other coupling means.

The first end of each of the space maintaining portions 16 is fixed to an outer end of the corresponding umbrella rib 4 and the second end of each of the space maintaining portions 16 is fixed to a central portion (a portion corresponding to a portion where a lower end of the upper canopy 12 is located) of the corresponding umbrella rib 4.

Each of the space maintaining portions 16 is roughly cone-shaped and fixed to the corresponding umbrella rib 4. A width of each of the space maintaining portions 16 gradually increases toward the central portion of the corresponding umbrella rib 4. That is, the width of each of the space maintaining portion 16 is almost identical to a diameter of the corresponding umbrella rib 4 at the outer end of the corresponding umbrella rib 4 and gradually increases as it goes toward the central portion of the corresponding umbrella rib 4.

The space maintaining portions 16 and the lower canopy 14 may be fixed to each other through needlework. Therefore, when the umbrella is unfolded, the space A is formed between the upper canopy 12 and the lower canopy 14 by the width of the upper ends (inner ends) of the space maintaining portions 16. That is, a size of the space A is determined by the width of the upper end of the space maintaining portions 16.

The space A is formed to correspond to an entire circumference of the canopy or to a portion of the circumference of the canopy.

With this structure, the upper canopy 12 contacts a top surface of each of the umbrella ribs 4 and the lower canopy 14 is located to be spaced apart from a bottom surface of each of the umbrella ribs 4.

Accordingly, the umbrella of the present embodiment can allow the user to secure a clear front view through the space A even when the user does not raise the umbrella to a high position or tilt the umbrella.

In use, even when the wind is directed to the umbrella, the wind comes into the umbrella and goes out of the umbrella through the space A defined between the upper and lower canopies 12 and 14. Therefore, the umbrella does not turn inside out.

The lower canopy 14 may be provided with a blocking step 18 formed by folding an end portion thereof many times, thereby preventing rainwater from entering into the umbrella.

In order to fix the upper edge of the lower canopy 14, the upper edge of the lower canopy 14 may be connected to the umbrella ribs 4 by loops 20.

The above-described structure may be applied to umbrellas for rain and snow, and to parasols, etc. In the case of umbrellas used primarily for the rain, it is desirable that the blocking step 18 be included in the configuration to prevent rainwater from entering into the umbrella through the space A. However, for umbrellas or parasols used primarily to protect against the rays of the sun, there is no need to form the blocking step 18.

The above-described umbrella may be manufactured using the conventional umbrella support, umbrella ribs, and support ribs, but a change to the canopy structure is required.

In use of the above-described umbrella, when the slider 8 moves upward along the umbrella support 2, the support ribs 6 and the umbrella ribs 4 spread and thus the upper and lower canopies 12 and 14 are unfolded by the tension of the support ribs 6 and the umbrella ribs 4.

When the slider 8 is fixed on the fixing portion 10, the umbrella maintains its unfolded state. At this point, since the lower canopy 14 is fixed on bottom portions of the space maintaining portions 16, the space A is formed between the upper and lower canopies 12 and 14 at the overlapping portion of the upper and lower canopies 12 and 14.

When the user positions the umbrella over his or her head, he or she takes shelter from the rain under the umbrella and advances while looking outwardly of the umbrella through the space A. Hence, the user is able to determine if there is any obstacle in the way of his or her path.

In addition, the blocking step 18 formed on the space A prevents rainwater from entering into the umbrella.

Further, when wind pressure is applied to the umbrella, the wind comes in and exits out through the space A formed between the upper and lower canopies 12 and 14, thereby reducing the resistance force and thus preventing the umbrella from being turned inside out.

Accordingly, when using the above-described umbrella according to the present invention, the user can view the area outwardly of the umbrella through the space A without risking inversion of the umbrella resulting from excessively tilting the same in high winds.

According to the present invention, the canopy of the umbrella is divided into the upper and low canopies to define the space A therebetween and thus, when the user positions the umbrella above his or her head, he or she takes shelter from the rain under the umbrella and advances while viewing the area outwardly of the umbrella through the space A without having to incline the umbrella. Thus, it becomes possible for the user to determine if there is any obstacle in the way of his or her path.

In addition, when wind pressure is applied to the umbrella, the wind comes in and exits out through the space A formed between the upper and lower canopies 12 and 14, thereby reducing the resistance force and thus preventing the umbrella from being turned inside out.

Although exemplary embodiments of the present invention have been described in detail hereinabove, it should be clearly understood that many variations and/or modifications of the basic inventive concept taught herein still fall within the spirit and scope of the present invention, as defined by the appended claims and their equivalents.

What is claimed is:

1. An umbrella comprising:

an umbrella support;

a plurality of umbrella ribs that are installed on an upper portion of the umbrella support and that are capable of being folded;

a plurality of support ribs respectively supporting the umbrella ribs;

a slider to which an end of each of the support ribs is hingedly coupled and which slides along the umbrella support to fold or unfold the umbrella ribs and the support ribs;

a canopy giving a user shelter from rays of the sun, rain, or snow, wherein the canopy is divided into an upper canopy installed on upper portions of the umbrella ribs and a lower canopy installed on lower portions of the umbrella ribs, and a space is formed between the upper and lower canopies when the umbrella is unfolded; and space maintaining portions fixedly inserted around the respective umbrella ribs, wherein the lower canopy is fixed on bottom portions of the space maintaining portions, wherein the upper canopy is located on top surfaces of the umbrella ribs so that an upper portion of the lower canopy is spaced apart from a lower portion of the upper canopy in a substantially vertical direction, thereby defining the space, and wherein each of the space maintaining portions is gradually widened as it goes from a lower portion of the corresponding umbrella rib toward an upper portion of the corresponding umbrella rib.

2. The umbrella of claim 1, wherein a lower portion of the upper canopy overlaps partly with an upper portion of the lower canopy in a circumferential direction.

3. The umbrella of claim 1, wherein the lower canopy is provided with a blocking step for preventing rainwater from entering into the umbrella.

4. The umbrella of claim 1, wherein an upper portion of the lower canopy is connected to the corresponding umbrella rib by a loop.

5. The umbrella of claim 1, wherein the space is formed along an entire circumference of the canopy or along a portion of the circumference of the canopy.

* * * * *